US005755364A

United States Patent [19]

LeCoffre et al.

[11] Patent Number: 5,755,364

[45] Date of Patent: May 26, 1998

[54] DEVICE FOR DISPENSING FLUID AT VERY LOW FLOW RATES FROM A CONTAINER

[75] Inventors: Yves LeCoffre, 2, place Apvfil, 38000 Grenoble; Claude Tournassat, Chemin des Renoncules, 38330 Saint Ismier; Xavier Bonazzi, 38610 Gieres, all of France

[73] Assignees: Yves LeCoffre, Grenoble; Claude Tournassat, Saint Ismier, both of France

[21] Appl. No.: 530,179

[22] PCT Filed: Mar. 4, 1994

[86] PCT No.: PCT/FR94/00236

§ 371 Date: Sep. 6, 1995

§ 102(e) Date: Sep. 6, 1995

[87] PCT Pub. No.: WO94/20390

PCT Pub. Date: Sep. 15, 1994

[30] Foreign Application Priority Data

| | | | |
|---|---|---|---|
| Mar. 9, 1993 | [FR] | France | 93 02792 |
| Apr. 13, 1993 | [FR] | France | 93 04306 |
| Jul. 7, 1993 | [FR] | France | 93 08449 |
| Sep. 10, 1993 | [FR] | France | 93 11137 |

[51] Int. Cl.[6] ..... B67D 5/06

[52] U.S. Cl. ..... 222/564

[58] Field of Search ..... 222/1, 481.5, 482, 222/402.1, 564, 547; 138/50

[56] References Cited

U.S. PATENT DOCUMENTS

| | | | |
|---|---|---|---|
| 3,951,174 | 4/1976 | Conant | 138/150 |
| 3,980,110 | 9/1976 | Cain et al. | 222/564 |
| 4,739,901 | 4/1988 | Dorfman et al. | 222/564 |
| 5,119,970 | 6/1992 | Arieh et al. | 222/1 |

FOREIGN PATENT DOCUMENTS

| | | |
|---|---|---|
| 0028032 | 5/1981 | European Pat. Off. . |
| 2090556 | 1/1972 | France . |
| 2186949 | 8/1987 | United Kingdom . |
| 9009936 | 9/1990 | WIPO . |
| 9310389 | 5/1993 | WIPO . |

*Primary Examiner*—Philippe Derakshani
*Attorney, Agent, or Firm*—Notaro & Michalos P.C.

[57] ABSTRACT

The present invention relates to a method designed to control the flow rate of a fluid, generally a liquid, from a pressurized self-contained container (4). It is characterized in that a head loss is installed on the pressurized container, the head loss being constituted by a channel (14) of great length and small section obtained by using controlled clearance between two surfaces in contact so as to achieve laminar head loss. The method is applicable to commercially-available aerosol cans. In one embodiment, the channel (14) is connected to a dip tube (25) and to a diffuser (8).

30 Claims, 10 Drawing Sheets

FIG_1
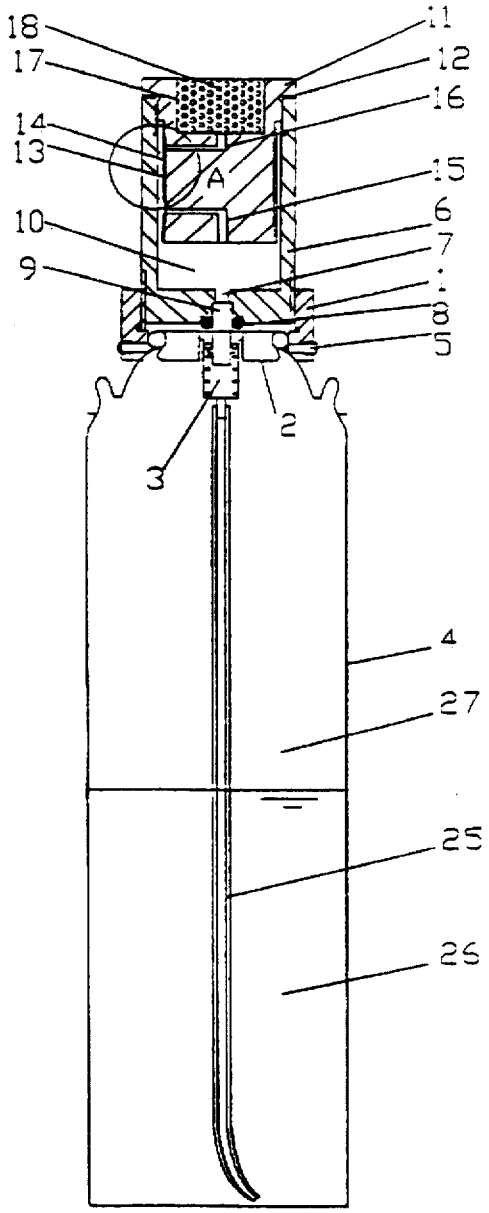
FIG_2
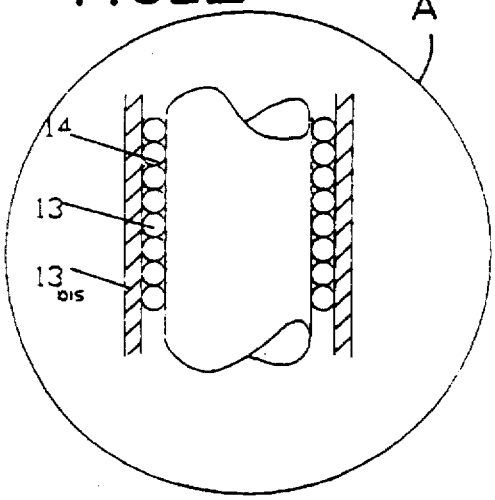
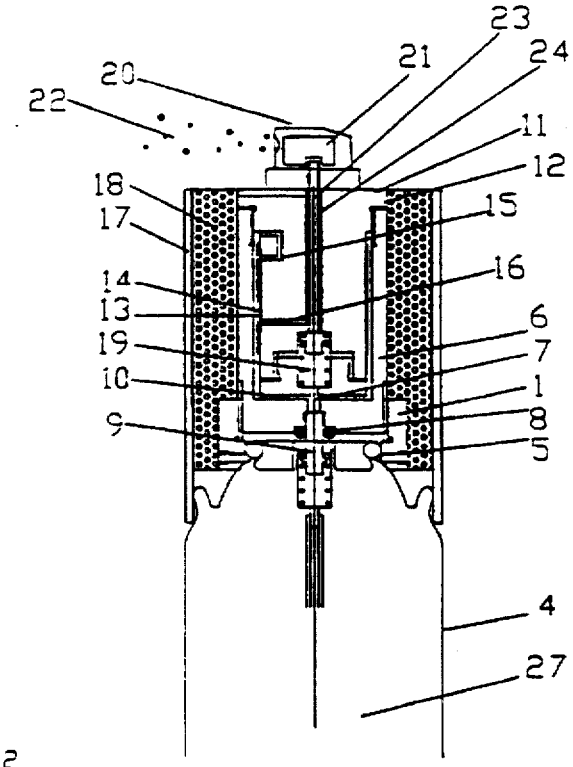
FIG_3
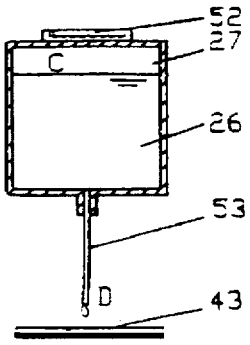
FIG_8

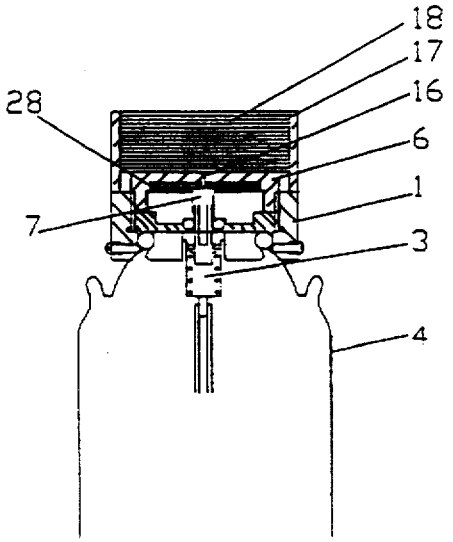
FIG_4
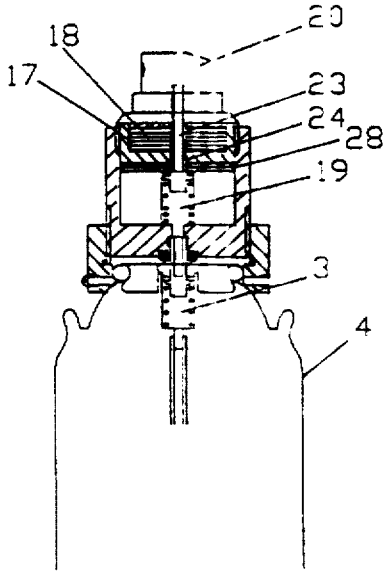
FIG_6
FIG_5a
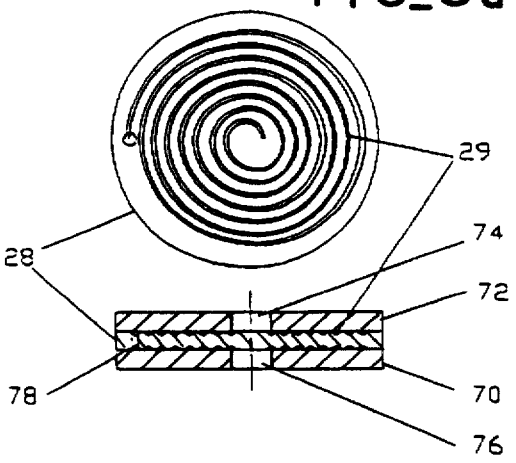
FIG_5b
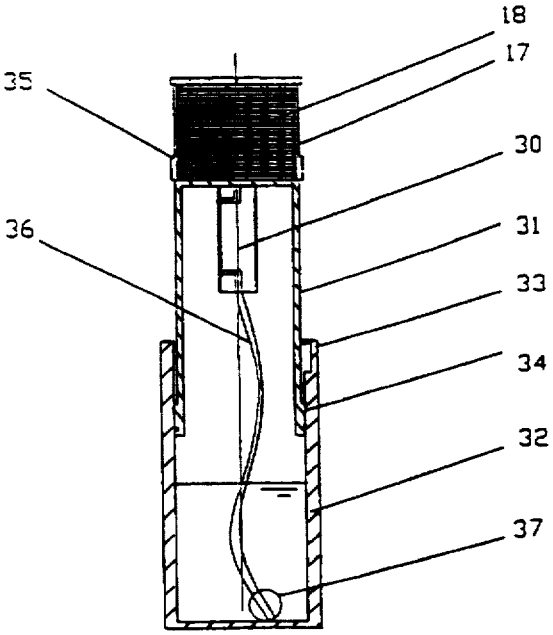
FIG_7

FIG_7a
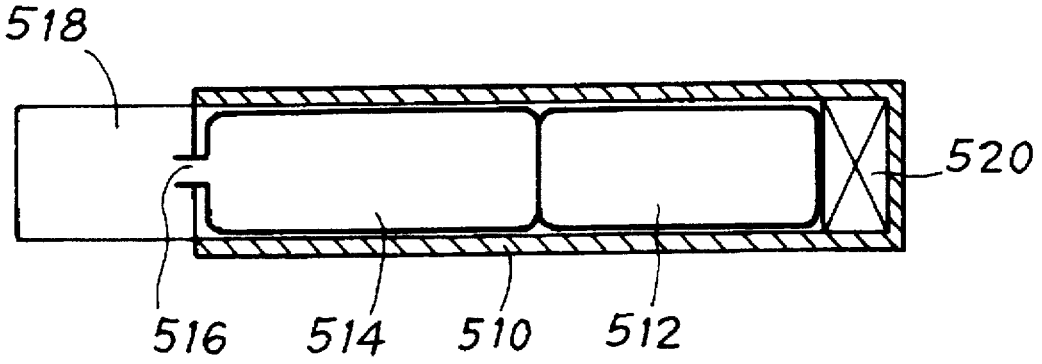
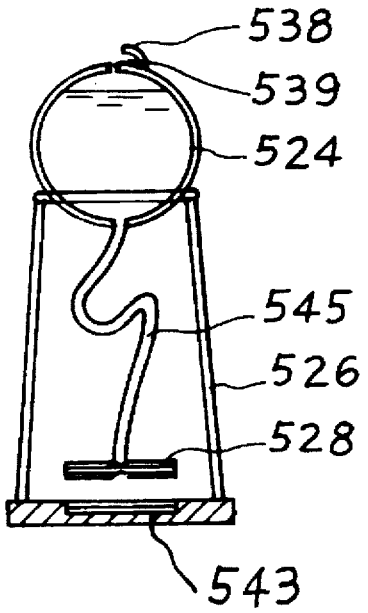
FIG_7b

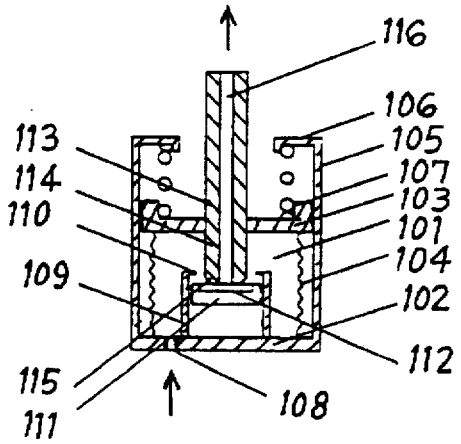
FIG_15
FIG_16
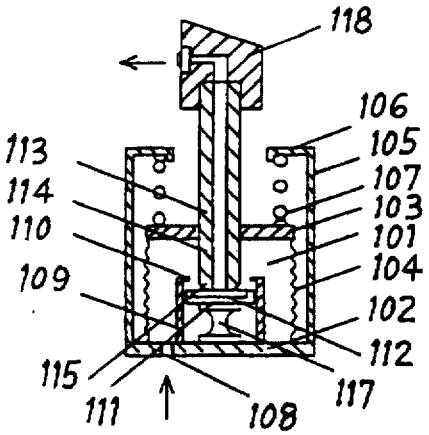
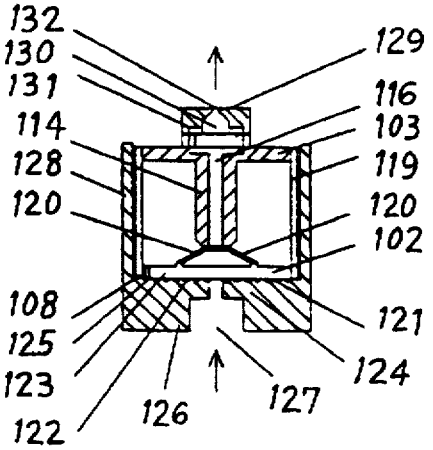
FIG_17
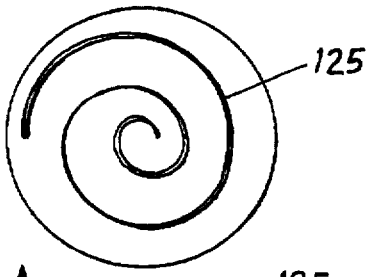
FIG_18a
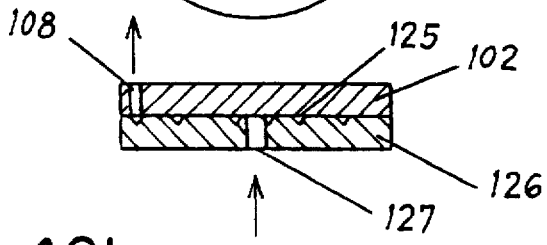
FIG_18b

DEVICE FOR DISPENSING FLUID AT VERY LOW FLOW RATES FROM A CONTAINER

FIELD AND BACKGROUND OF THE INVENTION

The present invention relates to a device for dispensing fluid at very low flow rates from a container.

Containers for storing liquid or gaseous substances, deodorizers, antiseptics, or the like, and generally used in a household or an industrial environment, enable these substances to be dispensed in the form of aerosols in response to voluntary actions by the user during a limited period of time. The action generally consists in pressing on a mechanism for opening a spring-loaded valve.

It would be advantageous to be able to dispense some of these fluid substances continuously and in very small quantities. This applies, for example, to deodorizers, to insecticides, or to air fresheners. Existing methods for performing this function, e.g. textile wicks, have flow rates that are difficult to control and, in general, they are difficult to implement.

Further, in numerous practical applications, in particular for deodorizers, fresheners, antiseptics, and insecticides, it is desirable for the slow and continuous diffusion to be accompanied by selective injections of substance into the atmosphere in the form of aerosols.

SUMMARY OF THE INVENTION

An object of the present invention is to provide a device enabling liquid to be dispensed at very low flow rates, typically less than 20 $cm^3$ per hour, while also ensuring that the flow rate is stable and constant, and by using static means. Preferably, the device is of low cost so as to be suitable for use in dispensing substances of low value such as deodorizers or air fresheners.

To achieve this object, the device for dispensing a liquid at very low flow rates is characterized in that it comprises:

a container suitable for receiving said fluid;

an outlet for said fluid flow; and capillary head loss means for controlling said fluid flow rate, said head loss means comprising first and second mechanical parts in mutual contact that are fixed relative to each other, said mechanical parts defining at their interface a channel of small section and of great length, said channel section being less than 1 $mm^2$.

Preferably, the section of said channel is less than 0.2 $mm^2$.

It will thus be understood that by using means that are entirely static it is possible to dispense a liquid or a gas contained in a container at very low flow rates because of the presence of capillary head loss means.

In a first embodiment, the device is characterized in that said head loss means are disposed at the outlet from said container, and in that said channel is connected firstly to said outlet and secondly to said container whereby said fluid can flow along said channel.

It will be understood that in this case it is the outflow of fluid from the container that is controlled directly. The fluid is preferably pressurized in the container.

In a second embodiment, the device is characterized in that said channel is connected firstly to the outside of said container and secondly to the inside of said container, whereby the fluid outside said container can flow along said channel into said container, thereby causing the fluid to be dispensed to flow out from said container.

In this second case, the external fluid may be the surrounding air. In which case the channel is directly connected to an air intake secured to the container. This fluid may also be pressurized. The capillary head loss device is then connected via its channel to an external container of fluid under pressure.

In an improved variant of the first embodiment, a device for dispensing the fluid intermittently may be interposed between the outlet end of the channel and the outlet of the device for dispensing fluid.

In another improved variant of the first embodiment, it is possible to adjust the fluid flow rate with great accuracy over a large range.

To do this, the capillary head loss means has n separate channels each preferably corresponding to a different flow rate, and the device further comprises control means for selectively connecting a first end of at least one of said channels to a first stationary duct and stationary means for connecting the second ends of all of the channels to a second stationary duct.

BRIEF DESCRIPTION OF THE DRAWINGS

Other characteristics and advantages of the present invention appear more clearly on reading the following description of various embodiments of the invention given as non-limiting examples. The description refers to the accompanying figures, in which:

FIG. 1 is a vertical section view through a first embodiment of the device for dispensing liquid and having a pressurized container;

FIG. 2 is a detailed view of FIG. 1 showing how the head loss device is embodied;

FIG. 3 is a fragmentary view of a first variant embodiment of the device for dispensing liquid;

FIG. 4 is a fragmentary vertical section view of another embodiment of the device for dispensing liquid that includes another embodiment of the head loss device;

FIGS. 5*a* and 5*b* are a plan view and a vertical section view of a second embodiment of the head loss device;

FIG. 6 is a fragmentary view of a device for dispensing liquid constituting another variant embodiment that includes manual control means;

FIG. 7 is a vertical section view through another embodiment of the device having another way of pressurizing the container;

FIG. 7*a* shows a variant way of pressurizing the container;

FIG. 7*b* shows another embodiment of the device with the liquid under pressure;

FIG. 8 shows another embodiment of the device for dispensing liquid with flow rate control on air admission;

FIG. 15 is a fragmentary view of the device for dispensing liquid showing a first embodiment of the intermittent dispensing means;

FIGS. 16 and 17 are other fragmentary views showing variant embodiments of the device for dispensing intermittently;

FIGS. 18*a* and 18*b* are a plan view and a vertical section view showing an embodiment of the capillary head loss device;

DESCRIPTION OF THE PREFERRED EMBODIMENTS

Figure 9:
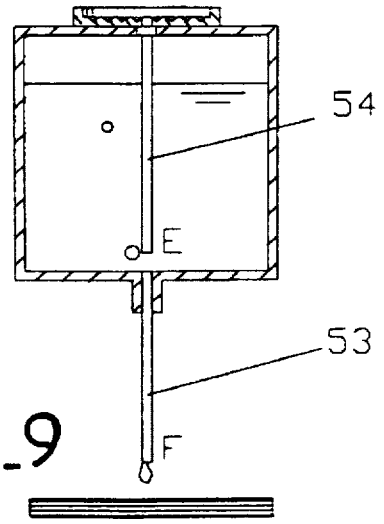
FIG. 9 is a variant of the FIG. 8 embodiment.
Figure 10:
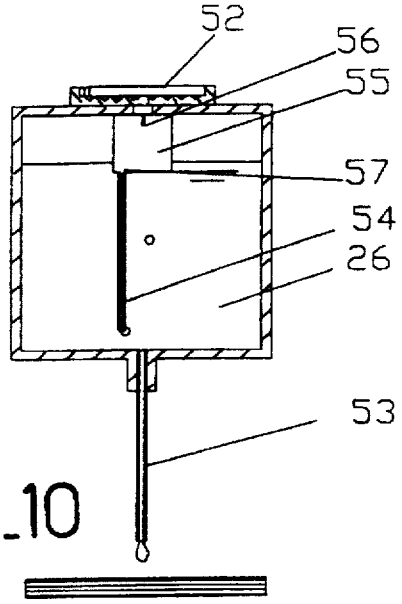
FIG. 10 shows a second variant embodiment of the FIG. 8 device.

With reference initially to FIGS. 1 to 7, various embodiments of the device for dispensing liquid using direct control are described.

In FIG. 1, there is shown the top portion of a commercially available pressurized container provided with a flow rate control system based on laminar head loss created in a passage formed between a cylinder and a spring, which method is known.

The part 1 is fixed on the support 2 of the spring-loaded valve 3 of the pressurized container 4 by means of screw 5. On this part, there is screwed a part 6 provided in its center with an orifice 7 and with a gasket 8 for sealing said part 6 relative to the top portion of the valve guide when said part 6 is screwed on. Initially, the screwing action enables the valve 3 to be opened by applying thrust to the outlet pipe 9 associated with said valve.

The liquid leaving the container through the valve 3, the pipe 9, and then the orifice 7 penetrates into a chamber 10 provided between the part 6 and a cylindrical part 11 which is itself screwed to the top portion of the part 6. Between the two parts 6 and 11 there is a sealing gasket 12.

The cylindrical middle portion of the part 11 is surrounded by a spring 13 having touching turns, thereby creating a passage 14 between the turns and the cylinder. FIG. 2 is an enlarged view of this helical passage. The helical passage may be very small in size and it may thus constitute a channel of very great length. The liquid passes from the chamber 10 through the passage 15 and then along the spring prior to being expelled to the outside through the passage 16. In order to enable the fluid to diffuse slowly, it is possible to install a hydrophilic medium 18 in a receptacle, e.g. cotton wool which becomes impregnated with the liquid to be diffused before it allowing it to evaporate into the atmosphere.

This assembly constitutes a self-contained appliance enabling a liquid to be diffused very slowly from the pressurized container.

One of the essential elements of the system is the head loss device. When using a spring having a diameter of 20 mm and a height of 20 mm constituted by turns having a diameter of 200 microns, the flow rate leaving a container that is pressurized to one bar and that contains a liquid whose viscosity is equal to that of water is $8\times10^{-12}$ $m^3/s$, i.e. about 20 $cm^3$ per month. For a conventional container having a capacity of 250 $cm^3$, this makes it possible to diffuse the liquid substance uniformly over a period of about 1 year.

FIG. 3 shows an embodiment in which the delivery outlet is hybrid, comprising both laminar head loss as in the above case, and an aerosol generator integrated with the head loss.

The description of the laminar head loss is identical to that of FIG. 1. To implement the second function, a spring-loaded valve 19 is integrated in the spring-support cylinder and controlled by pushbutton 20, which may include an element 21 for setting the liquid flow into rotation, thereby enhancing the creation of droplets 22. Movement of the control button is transmitted via the pipe 23 that conveys the liquid from the outlet of the valve 19.

The assembly then operates as follows: the diffuser is brought into operation by screwing the part 6 into the part 1. This opens the valve 3. The liquid then diffuses towards the container 17 containing a hydrophilic diffusing medium 18 via orifices 7 and 15, then via the helical clearance between the spring and the cylinder 14, the outlet orifice 16, and the clearance that exists between the tube 23 and its guide hose 24. When the button 21 is pressed, the valve 19 opens and the liquid is guided via the hose 23 to the outlet 20, thereby enabling a high flow rate. This operation is generally intermittent. When the pressure on the button 20 is released, the flow is stopped and only the diffusion function remains active.

By unscrewing the part 6, it is possible to stop operation of the appliance completely by closing the valve 3.

FIG. 4 shows another embodiment enabling the same function of diffusion through a laminar head loss to be achieved. The essential difference compared with FIG. 1 lies in the embodiment of the laminar head loss. Instead of using a spring co-operating with a cylinder to create a narrow channel, a long groove is made in a pellet 28 which is shown in detail in FIGS. 5*a* and 5*b*. To achieve a water flow rate of 1 ml/h under a pressure difference of 1 bar, a groove is used having a section in the form of an equilateral triangle to a depth of 125 microns, and having a developed length that is equal to 1 meter (m).

There can be seen the fixing part 1 that receives the part 6 whose screw action serves to open the valve 3. After the valve has opened, the fluid 26 passes through the orifice 7, then penetrates into the groove 29 etched in the head loss pellet 28, and finally escapes into the receptacle 17 via the pipe 16. This solution makes it possible to provide an appliance that is more compact than the first appliance.

FIG. 6 shows a head loss pellet integrated with a controlled outlet. There can be seen the main elements of FIG. 3, the valve 19, the pipe 23, and the outlet button 20. Practical operation is the same as that described with reference to said FIG. 3.

Other embodiments can be envisaged without detracting from the generality of the method. These include using other methods of pressurizing the liquid, e.g. by resilient membranes or by means of flexible chambers that are put under pressure.

FIG. 7 shows an embodiment using an integrated flow rate limiter. The container is made up of two elements 31 and 32 that are slidable one relative to the other, and that are provided with a sealing ring 38. After the liquid 26 has been poured into the portion 32 of the container, the sliding element 31 is installed, thereby ensuring sealing. By pressing down said element 31, the air 27 and consequently the entire container is put under pressure. The pressed-down position of 31 is ensured by co-operation between a resilient catch 33 and a shoulder 35. In this example, the catch 33 also makes it possible to avoid unwanted opening by causing the element 31 to engage a second shoulder 34.

The operation of this container is thus similar to those described above. When pressurization is performed, the fluid passes through the pipe 36 which is weighted down by a mass 37 so as to enable it to operate in any position, after which the liquid passes through the flow rate limiter 30 and penetrates into the receptacle 17 which contains the diffusing medium 18.

Naturally, it is possible for such a container to have added thereto a container an aerosol generator under the control of an external button.

Slow diffusers and assemblies including a diffuser together with a controlled outlet can be mounted on all types of containers that are pressurized by factory filling, by manual action, by using gas cartridges, or by any other mechanical or chemical means known to the person skilled in the art.

The diffusion or spray device shown in FIG. 7*a* includes an external container 510 made of a material that is capable of mechanically withstanding the pressures used in such a device. Preferably, the container is cylindrical in shape and made using a material that is biodegradable or easily recyclable. For example, the outer container is made using card or a similar material. Inside the container there is a first deformable sealed enclosure 512 which is initially filled with gas under pressure constituting the propellant gas. The propellant gas is preferably non-condensable, thereby limiting the danger of accidents by excess pressure due to a rise in temperature. Inside the container 512 there is a second sealed deformable enclosure 514 which contains the fluid that is to be diffused or sprayed. This enclosure 514 includes an outlet pipe 516 which is connected to a diffusion head 518 which is of the above-described laminar head loss type.

In a preferred embodiment, there are also provided means 520 for recharging compressed gas into the enclosure 512 that contains the propellant gas.

The operation of the diffusion or spray device can clearly be seen. When the diffusion head 518 is open, the fluid contained in the deformable enclosure 514 is expelled little by little from said enclosure under the effect of the pressure of the gas in the enclosure 512. This enclosure tends to apply pressure on the enclosure 514 which is also held by the mechanically strong wall 510 of the outer container. In the preferred embodiment, the recharging device 520 enables the enclosure 512 to be refilled with gas as it becomes larger, which is a result of the quantity of fluid contained in the deformable enclosure 514 diminishing progressively.

It will be understood that since the propellant gas is enclosed in the enclosure 512 and since the fluid to be diffused is enclosed in the enclosure 514, with both of these enclosures being sealed, there is no need for the container 10 itself to be sealed, it suffices merely that it withstands the pressures used in the deformable enclosure 512. This thus makes it possible to make the outer enclosure 510 using a biodegradable material, such as card, that is easily recyclable, while nevertheless having the desired mechanical strength, and that may be porous.

It will also be understood that the gastight enclosures 512 and 514 do not need to be resilient, they only need to be deformable, and this applies in particular to the enclosure 512 which needs to accept an ever increasing quantity of compressed gas.

FIG. 7*b* illustrates an embodiment in which flow rate control is obtained by means of a laminar head loss device, with the liquid or fluid to be dispensed being "pressurized" only by gravity. This device comprises a container 524 that is held at a certain level by a support 526. The flow rate limiter 528 mounted in a self-contained housing is connected to the outlet of the container by a flexible hose 545. By modifying the position of the container relative to the head loss device, it is possible to modify the outlet flow rate from the device.

Another advantageous way of regulating the flow rate of liquid leaving the container consists in restricting air inlet into the container instead of restricting water outlet. The basic solution shown in FIG. 8 consists in providing the air inlet with a laminar head loss 52 such that the volume flow rate of air penetrating into the container remains much less than that which would naturally flow through the water outlet orifice 53 if the air inlet orifice were of large size. The size of the liquid outlet is then designed by the person skilled in the art so that its head loss is much less than that of the air inlet. For example, for a water flow rate of 100 ml/month, in a container where the difference in height between the points C and D is 50 mm, the laminar head loss applied to air could be constituted by an etched spiral of length 1 m and of depth 110 mm. The water outlet 53 would then be constituted by a capillary tube of length 40 mm and of diameter 400 mm. The liquid flow rate then becomes practically independent of the nature of the liquid, and in particular of its viscosity. The dynamic viscosity of air, to which flow rate is proportional, varies little over the range of ordinary temperatures. It varies from $1.4\times10^{-5}$ at 0° C. to $1.9\times10^{-5}$ at 40° C. As a result variations in liquid flow rate are hardly perceptible when temperature varies.

In the variant of this type of flow rate regulation by acting on the air inlet as shown in FIG. 9, it is possible to ensure a constant flow rate by providing the air inlet with a tube 54 dipping into the container. This then imposes a constant pressure at the point of injection which is equal to:

$$Pa-\rho g\Delta h \text{ Pascals}$$

where Pa is atmospheric pressure, and $\Delta h$ is the difference in height between the point E at the outlet of the pipe and the point F at the outlet for liquid to the outside. $\rho$ is the density of the liquid, and g is the acceleration due to gravity.

The pressure difference $\Delta p$ across the terminals of the laminar head loss for air thus becomes constant and equal to $\rho g\Delta h$. The flow rate, which is proportional thereto, is thus constant.

One of the obstacles to proper operation of a gravity system with flow rate regulated by the air inlet is associated with the fact that water can penetrate into the capillary if the container is knocked over or turned upside-down. In addition to enabling a constant flow rate to be obtained, installing a dip tube 54 on the air inlet makes it possible to limit these risks. It suffices to ensure that the container is not completely filled so that the tube opens out above the free surface when the appliance is turned upside-down. The tube should also be small enough to ensure that capillary effects impede the flow of liquid when the container is on its side. Finally, a small intermediate chamber 55 may be placed between said tube and the laminar head loss element, thereby making it possible to avoid direct contact between the liquid and the laminar head loss. The inlet orifice 56 and the outlet orifice 57 of said chamber should then be offset so that drops of liquid penetrating into the chamber under the effect of gravity or because of shaking or stirring are not directed to the tube connecting the chamber to the capillary. These dispositions limit the risk of liquid penetrating into the head loss element which could disturb operation thereof.

Figure 11:
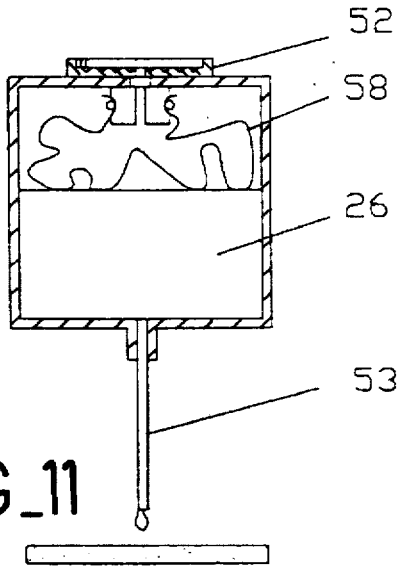
FIGS. 11 and 12 are vertical sections through other ways of controlling air ingress into the container.

A variant solution illustrated in FIG. 11 makes it possible to avoid any return of liquid into the capillary element, and it consists in installing an extremely flexible membrane 58 between the liquid surface and the capillary, thereby physically separating the liquid and the gas. Under such circumstances, it is no longer possible to implement the method that consists in using a capillary tube, so it is desirable to restrict the height of the container.

Figure 12:
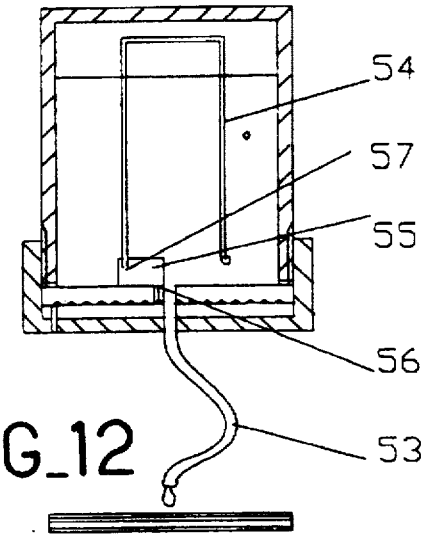

Finally, FIG. 12 shows a controlled air intake container whose air intake and liquid outlet are situated in a plug of the container, in the bottom portion thereof. In this example, there can be seen the tube 54 which is preferably U-shaped, and also the protection chamber 55 provided with its inlet 56 and its outlet 57.

Here again, all of these solutions are given as examples. The person skilled in the art will be able to devise variants that also come within the invention.

Figure 13:
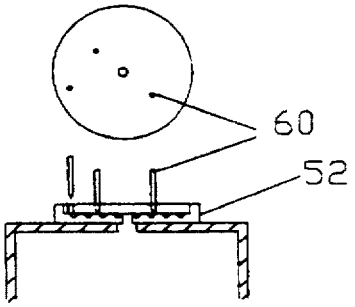
FIGS. 13 and 14 show ways of controlling the inlet flow rate of air into the container.

FIG. 13 shows an example of spiral-type linear head loss adjustment by means of shutters 59 distributed along the channel and enabling contact to be made with the surrounding atmosphere at various different points along the channel. It is thus easy to change the working length of the channel. The flow rate which is proportional thereto (assuming that the section of the channel is constant) is thus likewise capable of being modified by this contrivance. By closing all of the orifices for making contact with the atmosphere, a new on/off function is added to the above function.

Figure 14:
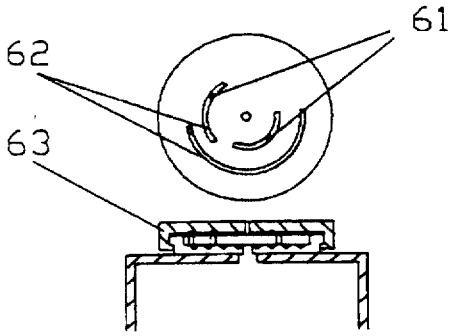

FIG. 14 shows an example of the device that makes it possible to perform the same function by closing orifices using balls 61 or gaskets that are placed on angular sectors 62. By rotating the cover 63 it is possible to close one or other of the orifices, thereby performing adjustments and achieving on/off operation.

These two types of embodiment are given as examples. Variable closure of the channels can be achieved in all of the cases mentioned in the description and the methods of doing so can be very varied.

In the embodiments described above, the flow rate of the liquid leaving the container is very low, but continuous. In some applications, it can be advantageous to have a device which makes it possible to dispense a liquid flow rate that is very small but in such a manner that the liquid actually leaves the container in intermittent manner only, the mean flow rate continuing to have the same order of magnitude as mentioned above. Accompanying FIGS. 15 to 21 show various embodiments of means enabling the liquid to be dispensed intermittently.

FIG. 15 shows an embodiment of an appliance for creating an intermittent flow of fluid from a continuous flow of said fluid, preferably at a low flow rate. The appliance includes a chamber 101 made up of a stationary end wall 102 and a moving end wall 103 having a substantially cylindrical wall 104 constituted by a metal bellows. The assembly is surrounded by a cylindrical case 105 provided with an inwardly directed rim 106 serving to compress a spring 107 situated between the moving end wall 103 of the chamber 101 and the stationary rim 106 of the case 105. The fluid is injected in controlled manner at 108 into the chamber 101. A small cylindrical chamber 109 including an inwardly directed rim 112 is placed on the stationary end wall 102, the rim 110 serving to limit the stroke of a cylindrical shutter 111 carrying a gasket 112. The shutter 111 is free to move axially in the chamber 109. In the absence of external forces, the shutter tends naturally to move down to the bottom of the chamber 109 under the effect of gravity. The moving end wall 103 is provided with outlet pipe 113 connected thereto and with a pipe 114 that is also connected thereto and that is placed in the chamber 101 having an end 115 capable of penetrating into the chamber 109 and coming into contact with the gasket 112 on the moving shutter 111. The two pipes are interconnected by a common internal duct 116 in both sections.

The appliance of the invention operates as follows: Initially, the chamber 101 is preferably filled with the fluid to be dispersed. The pipe 114 bears against the gasket 112 on the shutter 111 at the end of the chamber 109. As soon as fluid penetrates via 108 into the chamber 101, the pressure in the chamber 101 becomes equal to the pressure that results from the action of the spring 107. With the spring 107 exerting a force $F_1$, and with the chamber being of section F, the pressure in the chamber is equal to $F_1/S$. Under the effect of this pressure, the shutter engages the end 115 of the pipe 114, thereby closing it because of the presence of the gasket 112. The vertical force $F_2$ exerted on the shutter is equal to sP. The dimensions of the assembly are such that this force is greater than the weight of the shutter 111. By penetrating into the chamber 101, the fluid causes the end wall 103 to move and consequently moves the assembly formed by the pipe 114 and the shutter 111. Driven in this way, the shutter rises in the chamber 109 until it reaches the rim 110. On making contact with the rim 110, the shutter loses contact with the pipe 114 and falls back under the effect of gravity into the bottom of the chamber 109. The fluid contained in the chamber 101 can then escape through the bore 116 formed through the pieces of pipe 113 and 114. As a result, the volume of the chamber 101 decreases until the gasket 112 of the shutter 111 is again in contact with the end 115 of the pipe 114, thereby preventing liquid from leaving. This process can then begin again indefinitely. This first version of the device corresponding to FIG. 1 assumes that the system is placed vertically so that the shutter 112 tends to move downwards naturally towards the bottom of the chamber 109.

FIG. 16 shows another embodiment of the invention in which the shutter 112 is connected to the stationary end 102 by a spring 117 of very small stiffness, the other elements of the device remaining unchanged with the exception of the outlet pipe 113 which is provided with a device 118 making it possible to establish dispersion in the form of a fine droplets by using a rotating flow, which method is used in commercially available aerosol cans.

In FIG. 17, the chamber 101 is put under pressure by a resilient membrane 19 that replaces the spring 107. The force F is created by said membrane being extended. Also, the shutter device is implemented as a membrane 120 which is secured to the stationary end wall 102. In FIG. 3, this device is shown at half stroke. It is connected to the pipe 114 by the effect of the above-mentioned pressurization. As the moving end wall 103 moves, the membrane 120 is tensioned, until this tension force compensates exactly the force $F_2$ that results from the pressure difference between the chamber 101 and the outlet over the section of the pipe 114. At this moment, the membrane releases the pipe 114 suddenly and drops back to the bottom of the chamber 101. After the chamber has been emptied, the pipe 114 makes contact with the membrane 120 again, and adheres thereto by suction, so the cycle can begin again. In FIG. 17, the chamber 101 is fed via a laminar head loss 121 constituted by a spiral channel 122 formed by co-operation between a plane pellet 123 and a pellet 124 having a spiral-shaped groove 125 etched therein. FIG. 4 shows a detail of this feed. As in the case of FIG. 3, the groove is etched in the part 126 which is connected to the liquid feed 127 and which is provided with a cylinder 128 for guiding the displacements of the end wall 103 of the chamber 101 and of the resilient membrane 119. In addition, in this FIG. 17, there is shown a fluid outlet 129 secured to the end wall 103 for the purpose of achieving dispersion of droplets. To do this, a cylindrical chamber 130 is fed from the tube 116 via two liquid inlets 131 that penetrate tangentially into said chamber. The fluid is thus caused to rotate inside the chamber 130 and escapes therefrom through a small diameter orifice 132 in the form of a conical sheet which breaks up into droplets.

By way of example, we give a few figures relating to FIG. 17. The diameter of the chamber 101 is 20 mm; its height is 30 mm. The maximum stroke of the end wall 103 is 3 mm. The volume of fluid ejected on each cycle is thus 940 $mm^3$. The total length of the groove is 1 m and it is in the form of an equilateral triangle having a depth of 0.2 mm. The hold of the resilient membrane is 5 kg. The pressure inside the chamber 101 is thus 1.6 bars. The assembly is fed with cold water at 20° C. at 4 bars. The mean flow rate in the chamber is $4\times10^{-9}$ $m^3/s$, i.e. 13.5 $cm^3/h$. The duration of the trip cycle is thus 4.4 min. This example is given for illustrative purposes. It is possible to use other dimensions that are very different.

FIGS. 18*a* and 18*b* give a perspective view of the spiral laminar head loss used for feeding the chamber 101. To facilitate understanding, the parts 102 and 126 are represented diagrammatically as two cylindrical pellets. The fluid penetrates at 127 through the part 126, and feeds the spiral of which only one turn is shown, after which it leaves the groove via orifice 133 that feeds the chamber 101.

Patent application PCT/FR 92/01075 describes another embodiment of a channel of very small flow section achieved by associating a cylinder and a helical spring wound on said cylinder. Such a very low flow rate device could be substituted for the device shown in FIGS. 17 and 18.

Figure 19:
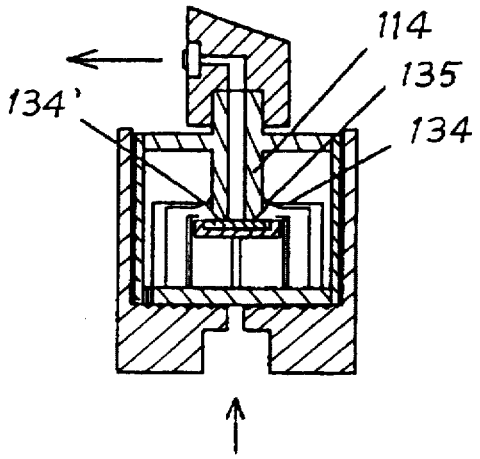
FIGS. 19 and 20 show further variant embodiments of the device for dispensing liquid intermittently.

FIG. 19 shows a variant of the above devices characterized in that the shutter is disconnected by the action of a flexing spring 134, which method we call an assisted system. As before, the shutter is entrained by the pipe 114 which is provided with a projection 135. When the pipe 114 rises, the spring whose end 136 is situated above the projection at the beginning of filling now bears against said projection and is progressively deflected upwards. At a critical point corresponding to the maximum stroke, the spring is deflected sufficiently for the projection 135 to be no longer capable of retaining it. The spring then relaxes downwards and entrains the shutter, thus improving the reliability of opening. During the descent of the pipe 114, the projection again moves past the end 136 of the spring, which is thus re-cocked. The pipe sucks up the shutter and the cycle can begin again.

Figure 20:
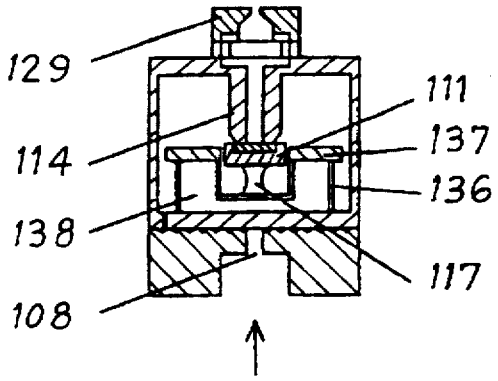

In FIG. 20, there can be seen a pneumatic pressurization device situated inside the chamber 101. The chamber 138 contains gas under pressure and cannot deform because of the presence of a resilient membrane 136 constituting the cylindrical side walls of the device. The rigid moving end wall 137 of the chamber 138 is provided with a shutter 111 to which it is connected by a spring 117 via a rigid internal cylindrical partition 139. The walls of the chamber 101 are rigid. Operation is then as follows: when the appliance is brought into operation, the liquid penetrates at 108 into the chamber 101. As a result the volume of the chamber 138 decreases and the end wall 137 moves away from the stationary end wall 3. The shutter 111 is then associated with the pipe 114. This displacement puts the spring 117 under tension. Once the tension is sufficient, the shutter releases the pipe 114 and falls back into its housing provided in the end wall 137 of the chamber 138. Emptying then takes place with the end wall 137 moving closer to the pipe 114 and the shutter 11 then sticking to said pipe so as to enable the cycle to begin again.

These figures are merely embodiments of the device, and other, similar, systems could be envisaged, both with respect to pressurizing the chamber 101 which can be achieved by various mechanical or pneumatic methods, and with respect to the details concerning implementation of the shutter and the systems that enable it to become unstuck, with or without assistance.

Figure 21:
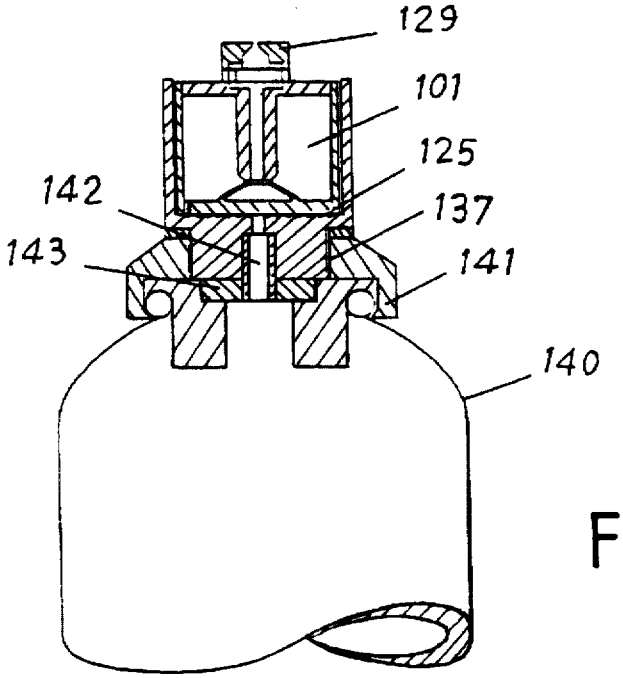
FIG. 21 shows one example of the FIG. 17 device mounted on a container.

In FIG. 21, there can be seen the system for controlling the filling flow rate by using a spiral channel 121, together with the outlet head that enables droplets to be produced. In this example, the fluid to be dispersed comes from a commercially-available pressurized can 134 that contains the fluid to be dispersed. The system is integrated with an assembly enabling the can to be put into operation merely by clipping on the part 135, which operation serves in turn to open the valve of the can by pressing down the outlet pipe of said can. This thus provides an aerosol generator that operates intermittently from a self-contained container. In this embodiment, the device of the invention is connected by a thread to the part 141. By screwing the intermediate part 126 of said device into the part 141, the pipe 142 of the aerosol can is caused simultaneously to be pushed down while the gasket 143 is compressed, thereby ensuring sealing. This action enables the system to be put into operation. By unscrewing the part 126, operation of the device is stopped.

It will be understood that in this implementation of the invention, it is possible to convert a continuous fluid flow rate into an intermittent flow rate that is equal thereto on average, with the system being capable of operating, if so required, in any position, and of treating a very wide range of flow rates, and optionally of being mounted on self-contained containers such as commercially available aerosols cans without requiring any changes to the design of said cans.

The description above deals with the general case of a fluid. Naturally, the fluid is preferably a liquid such as a freshener, an antiseptic, or even water for controlling the humidity of premises. However, the fluid could also be a gas.

In the embodiments described with reference to FIGS. 8 to 15, the rate at which the liquid flows out from the container is controlled by controlling the rate at which air is admitted into the same container. More precisely, the air is air from the surroundings and it is therefore at atmospheric pressure. In some applications, it may be advantageous to control a flow rate of a fluid that is already pressurized. This is illustrated in FIGS. 22 to 24.

Figure 22:
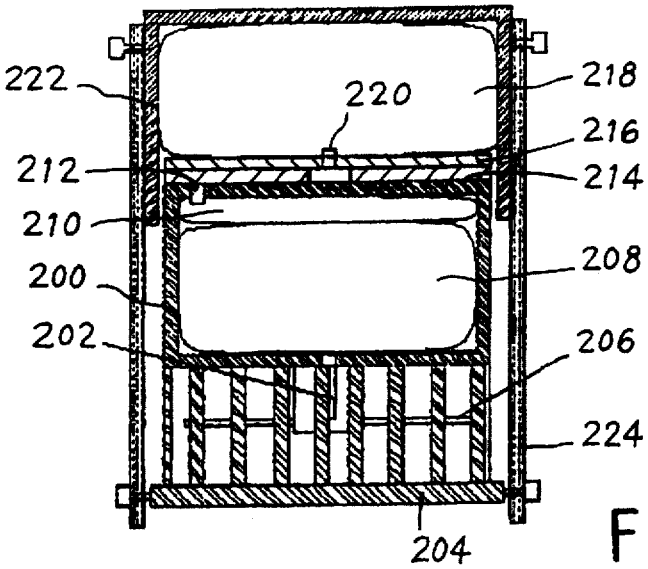
FIG. 22 is a vertical section through an embodiment of the device for dispensing liquid with pressurized air inlet control.

In FIG. 22, there can be seen a container 200 that withstands pressure, and an outlet capillary 202 therefrom, together with its support structure 204 that enables the container 200 to be held in the vertical position in such a manner that its outlet is at its bottom end. There can also be seen, drawn in diagrammatic manner, a liquid diffuser 206. Inside the container 200 there is a deformable sealed bag 208 containing the liquid to be diffused. The bag 208 is naturally connected to the outlet 202. In the container 200 there is also a bag 210 that is initially substantially empty and which is likewise sealed and deformable. The bag 210 is connected via an orifice 212 formed in the end 214 of the container to a capillary head loss device 216 which is of the etched groove type, for example. Above the head loss device 216 there is mounted a deformable sealed enclosure 218 which contains an intermediate fluid such as a mixture of water and glycol. The enclosure 218 is connected to the inlet 220 of the capillary head loss device 216. Pressurization means for the bag 216 are constituted, for example, by a cover 222 surrounding the bag 218 and capable of sliding over the outside walls of the container 200. Resilient systems such as 224 tend to press the cover 222 against the enclosure 218 and thus comprises the intermediate liquid contained in the bag 218. The liquid leaves at a controlled flow rate through the head loss device 216 to fill the bag 210 little by little, thereby increasing the pressure on the bag 208 containing the liquid to be diffused and thus enabling it to be delivered at a controlled flow rate by the outlet capillary 202.

Figure 23:
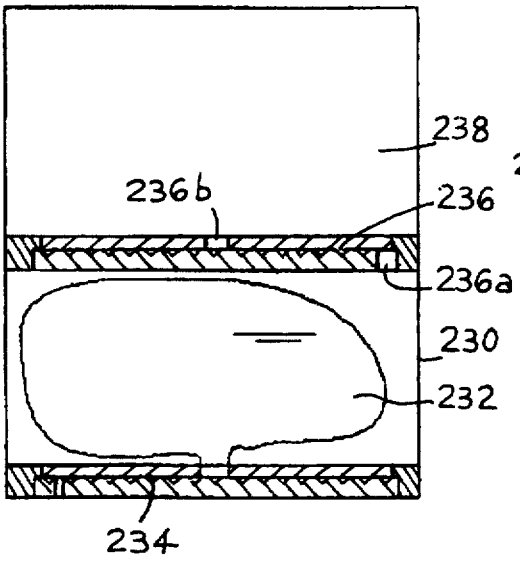
FIG. 23 is a vertical section through a variant of the FIG. 22 embodiment.

In the embodiment shown in FIG. 23, the pressure-withstanding container 230 contains a sealed flexible bag 232 in which the fluid to be dispensed is stored. In this embodiment, the outlet from the bag 232 is connected to a head loss device 234 that provides relatively small head loss. Above the container 230 there is a second head loss device, e.g. of the etched groove type, 236, having its outlet **236*a* opening out into the container 230. The device 236 provides head loss that is considerably greater than that provided by the device 234. The inlet 236*b* of the head loss means is connected to a high pressure container containing a driving gas, which container is referenced 238. The high pressure container enables a substantially constant pressure to be maintained in the fluid passing through the head loss device 236. The gas thus fills the container 230 at a controlled flow rate, thereby applying pressure to the deformable bag 232, which in turn allows the liquid to escape in controlled manner, with said control being reinforced further by the presence of the second head loss 234**.

Figure 24:
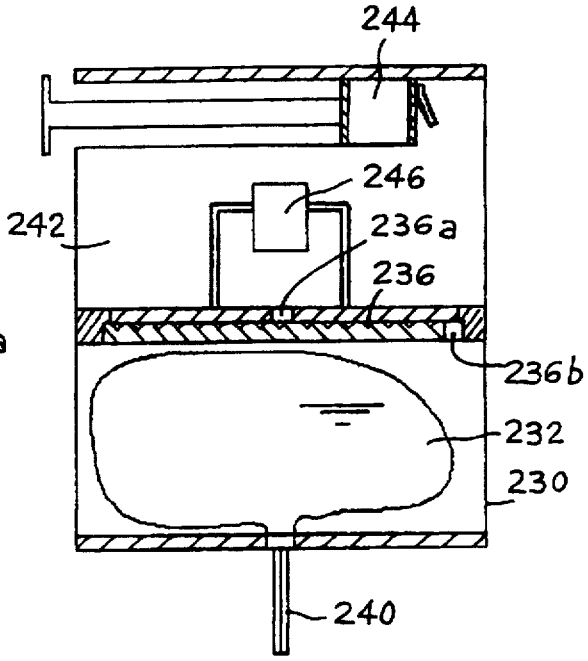
FIG. 24 shows a second variant of the FIG. 23 embodiment.

In the variant shown in FIG. 24, the device also includes a container 230 having a deformable bag 232 placed therein and containing the liquid to be diffused. In this embodiment, the bag 232 is directly connected to the outlet capillary 240. The head loss device 236 is fed with gas under pressure that is obtained as follows. Above the device 236 there is provided a container of gas under pressure 242 into which gas may periodically be inserted by means of a syringe type device 244. To ensure gas feed at constant pressure, an expander 246 is interposed between the gas under pressure contained in the container 242 and the inlet **236*b*** of the head loss device.

Figure 25:
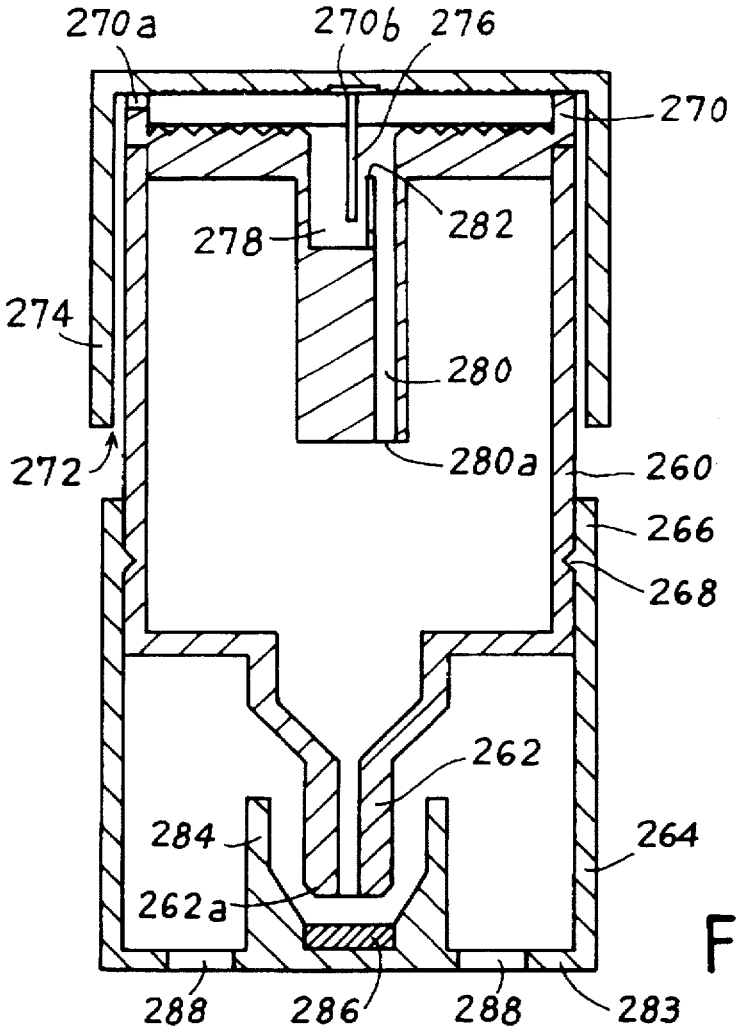
FIG. 25 is a vertical section through another embodiment of the device for dispensing liquid with air inlet control.

With reference to FIG. 25, there follows a description of yet another embodiment of the liquid dispenser device in which flow rate control is performed by controlling the admission of air at ambient pressure. The device is constituted by a sealed container that withstands pressure 260 which is provided with an outlet capillary hose 262. The container 260 is maintained in the vertical position by a support element 264 in the form of a cylindrical skirt whose periphery 266 cooperates with the cylindrical wall of the container 260 which is secured thereto by snap-fastening means 268, for example. The end wall of the container 260 is preferably constituted by a head loss device 270 of the etched groove type. The inlet **270*a* to the channel of the head loss device is connected to an air intake 272 which is, for example, constituted by a gap between the container 260 proper and a thermal protection skirt 274. The outlet 270*b* of the head loss device is connected to an outlet capillary 276 which is vertical and axial. The capillary 276 opens out into an overflow-forming receptacle 278. The receptacle 278 is connected to an outlet tube 280 via its overflow edge 282. The end 280*a* of the tube 280 opens out into the liquid contained in the container 260. The enclosure 278 makes it possible to avoid untimely ingress of liquid into the head loss control device. As can be seen in FIG. 25, the support element 264 includes a beaker 284 on its baseplate 283, which beaker faces the outlet capillary 262 in such a manner that the free end 262*a* of the capillary penetrates into the beaker 284. This disposition makes it possible to avoid risks of liquid rising and exiting in untimely manner via the capillary 262 under the effect of temperature variations, i.e. under the effect of variations in the volume of the liquid. The bottom of the beaker 284 preferably includes a gasket 286. Thus, pressing the container 260 down into the skirt 264 of the support means causes the end 262*a* of the outlet capillary to bear against the gasket 286, thereby closing off the container 260. Naturally, the baseplate 283 of the support device includes orifices 288** for liquid outlet.

Such an embodiment is particularly well adapted to the case where liquid is dispensed in an environment that may be invaded by water, such as a toilet bowl.

Figure 26:
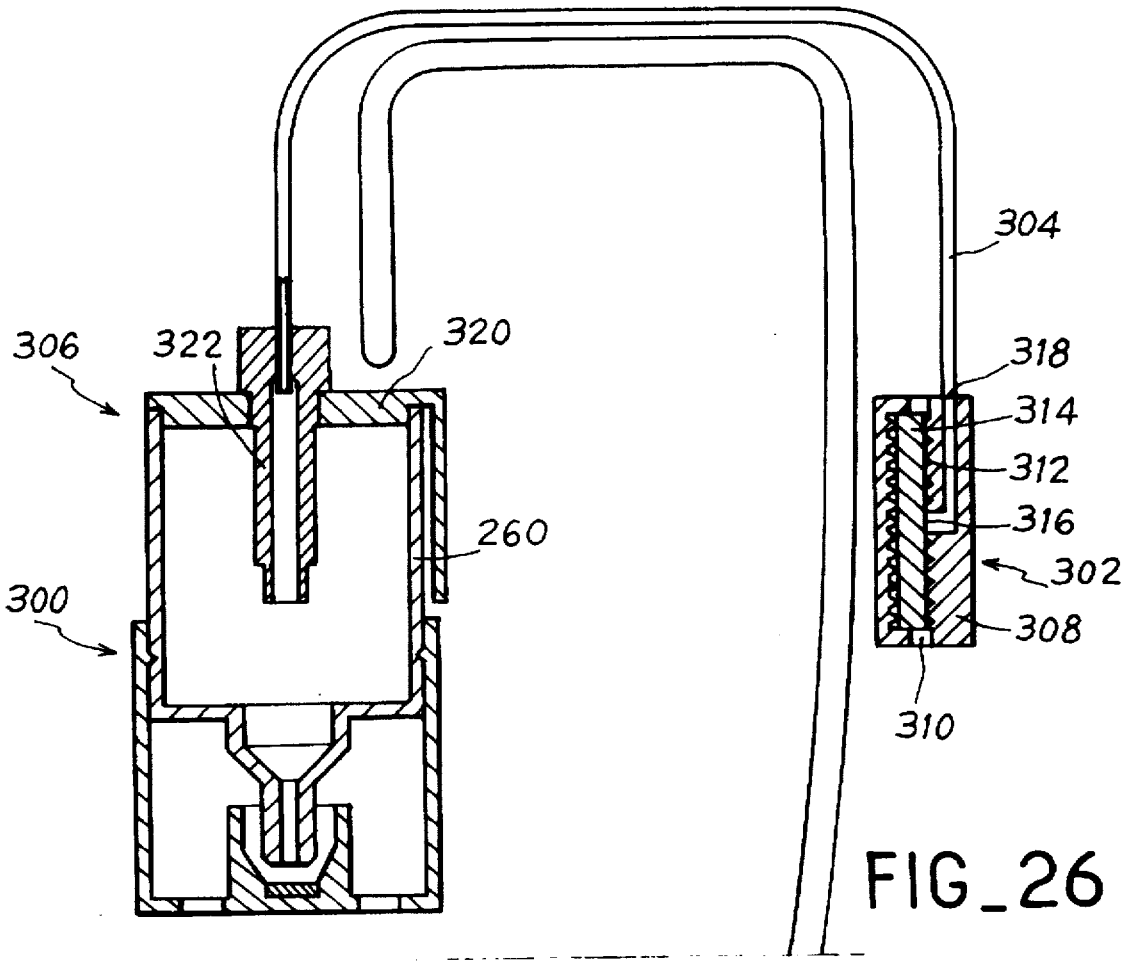
FIG. 26 shows an example of the device for dispensing liquid with air inlet control in use mounted on a toilet bowl, for example.

With reference now to FIG. 26, a variant of the device shown in FIG. 25 is described together with a preferred use of said variant. This variant embodiment essentially consists in separating the container 300 containing the liquid to be dispensed from the head loss device 302 for controlling air admission, and in uniting these two components by means of a flexible pipe 304. This disposition is particularly suitable for enabling a deodorizer or disinfectant to be dispensed in a toilet bowl. For example, the container 300 is placed to receive the flush water 306, whereas the head loss device 302 is naturally located on the outside. The head loss device essentially comprises a housing 308 including an air intake 310 which is connected to the inlet of the channel 312 of the head loss device proper 314. The outlet 316 of the channel 312 is connected to an outlet opening 318 which is itself connected to one end of the flexible hose 304. The container 300 has exactly the same structure as that described with reference to FIG. 25, with the exception that its end wall 320 is closed and is provided with an endpiece 322 which passes through the end wall 320 and which is connected to the hose 304. Thus, air at a flow rate that is controlled by the head loss device 314 penetrates into the container 260 containing the liquid to be dispensed.

Figure 27:
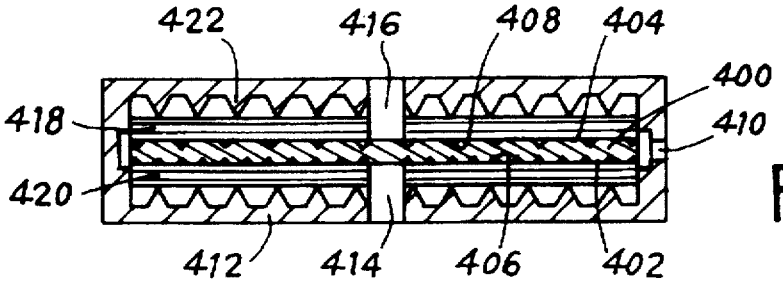
FIGS. 27 and 28 are vertical sections through two variant embodiments of the head loss device.
Figure 28:
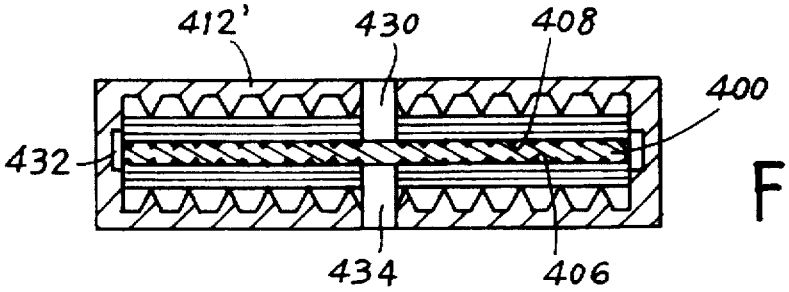

In the above description, it has been assumed that the head loss devices in a particular implementation were constituted by two facing plan faces. One of the facing faces has a long groove formed therein that is of very small right cross-section, thereby constituting the channel of the head loss device. In FIGS. 27 and 28, there can be seen two variant embodiments of the head loss device. In both embodiments, there is a central part 400, e.g. in the form of a disk having two plane faces 402 and 404, each of which has a groove formed therein, e.g. in spiral shape, and referenced 406, 408. Each of these grooves thus constitutes a laminar head loss channel. In the embodiment of FIG. 27, the head loss device includes an inlet 410 formed in the outer housing 412 of the device. This inlet 410 serves to feed the inlet of each of the channels 406 and 408. In the central region of the device there is a first outlet 414 corresponding to the groove 406, and a second outlet 416 corresponding to the groove 408. A system is thus provided which, starting from a single inlet intake 410, serves to deliver two controlled flow rates of fluid, e.g. air. Thus, by connecting each outlet to a respective liquid container (FIG. 26) via a respective pipe, it is possible to control the dispensing of two fluids contained in the two containers. FIG. 27 also shows an improvement consisting in improved sealing between the second face and the part 400 on which the grooves are etched. This improvement consists in installing a deformable sheet 418, 420 between the face that includes the groove and the face that faces it. In order to prevent the sheet 418 or 420 partially obstructing the groove by deformation, the facing face is not plane but, for example, includes concentric ribs 422 of which dimensions which are considerably greater than the corresponding dimensions of the groove. Thus, the ribs 422 effectively press the sealing sheet 418 against the face in which the groove is formed, but firstly because of the small surface area of the groove and secondly because of the spacing between the ribs, the sheet does not penetrate into the groove. The sheet 418 (or 420) may be constituted by a thin layer of a relatively hard material that comes into contact with the groove and by a thicker layer that is more deformable and that faces the ribs.

In the embodiment shown in FIG. 28, the central part 400 also has respective grooves referenced 406 and 408 in each of its faces. The channel constituted by the groove 408 has an axial inlet 430. An annular groove 432 is provided in the housing 412' causing the second end of the groove 408 to communicate with the first end of the groove 406. The second end of the groove 406 is connected to an outlet opening 434. A channel is thus obtained that is twice as long as would be obtained with a channel of the type described above.

With reference now to FIGS. 29 to 33, an improved embodiment of the head loss device is described that both enables the flow rate from the head loss device to be adjusted very accurately and also provides compensation for the effects of temperature variations on the viscosity of the liquid flowing through the head loss device, and thus on the effective flow rate. It will be understood that in the medical field, in particular, it can be most important to ensure that temperature compensation is provided so that the flow rate of the medication as dispensed remains constant regardless of variations in temperature, and it is also important to be able, where necessary, to alter the flow rate injected into the patient using the same device.

In this embodiment, a plurality of separate grooves or channels 450*a*, 450*b*, 450*c*, and 450*d* are etched in the top face of the part 452. Each channel a is preferably sinuous in shape so as to increase the length of the channel for a given diameter of the part 450. Each channel has an inlet A and an outlet B. The channels are preferably of different right cross-sections, and thus correspond to different flow rates, while nevertheless remaining within the ambit of the general definition of these channels. For example, the sections of the channels may be in the ratio 1:2:4:8.

The part 450 is associated with a rotary inlet manifold 454 which enables the fixed liquid feed pipe 456 to be connected to any combination of the various channels. This makes it possible to provide continuous adjustment of the overall flow rate in the ratio 1 to 15. The manifold may be replaced by controllable shutters, each shutter being mounted between the feed pipe 456 and the inlet to one of the channels 450.

As is well known, the viscosity of the liquid flowing along the various channels depends on the ambient temperature. For an aqueous solution, dynamic viscosity varies in the range $1.8\times10^{-3}$ Pa.s at 0° C. to a viscosity of $0.7\times10^{-3}$ Pa.s at 40° C. If it is desired that the device should be made insensitive to temperature, it is therefore necessary to adapt the effective length of a channel to the variations in viscosity that are due to variations in temperature. More precisely, with increasing temperature it is necessary to decrease the effective length of the channel.

To do this, n orifices are provided in the part 452 for each channel 450, each orifice opening out into the corresponding channel at a length of channel from the outlet B of the channel that is associated with the corresponding temperature correction to be provided. For example, four orifices made be provided corresponding to increasing temperatures $T_1$, $T_2$, $T_3$, and $T_M$, with a temperature $T_F$ causing all of the channel to be closed off, thereby closing off the device for a temperature that lies outside its range of use.

The orifices 458 of the channels corresponding to a given temperature are interconnected by a passage 460 formed in the bottom face 452*a* of the part 452. Each passage 460 corresponding to a regulation temperature is associated with a controllable shutter 462. The passages 460 are connected via the shutters 462 to an outlet pipe 464 formed in the part 466. A shutter 462 is caused to close as soon as the associated regulation temperature is reached. For example, the regulator $462_1$ is closed at temperature $T_1$, the regulator $462_2$ at temperature $T_2$, etc.

Figure 33A:
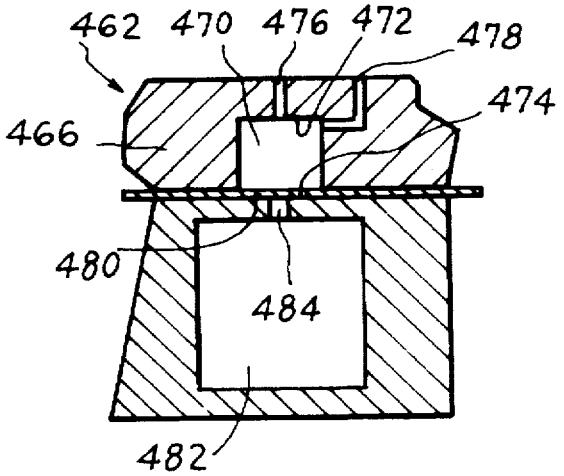
FIGS. 33*a* and 33*b* show a closure control device in its open position and its closed position, respectively.
Figure 33B:
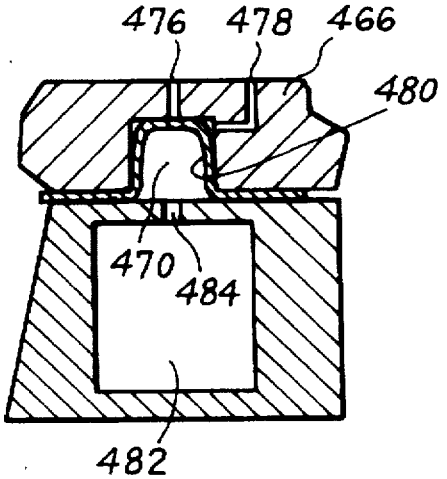
Figure 29:
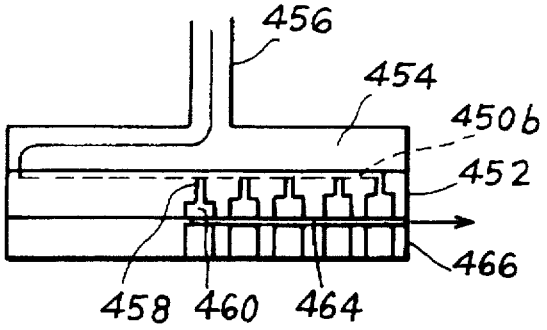
FIG. 29 is a vertical section view through a multichannel head loss device with flow rate adjustment and temperature compensation.
Figure 30:
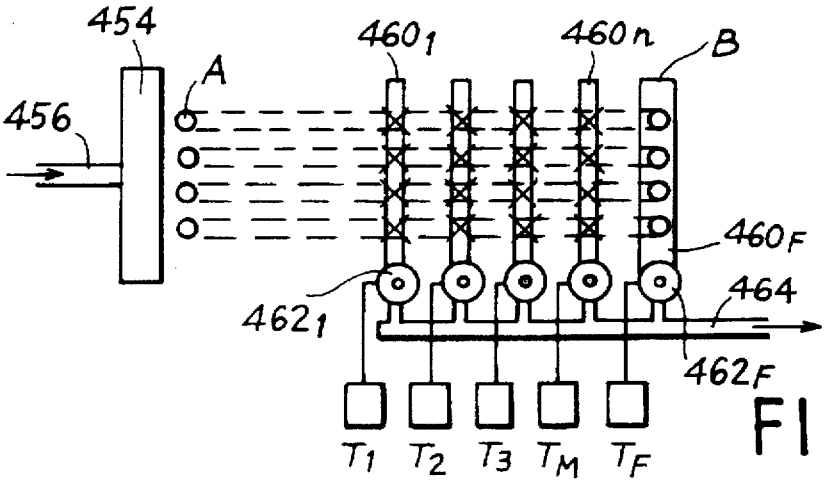
FIG. 30 is a diagram showing how the FIG. 29 device operates.
Figure 32:
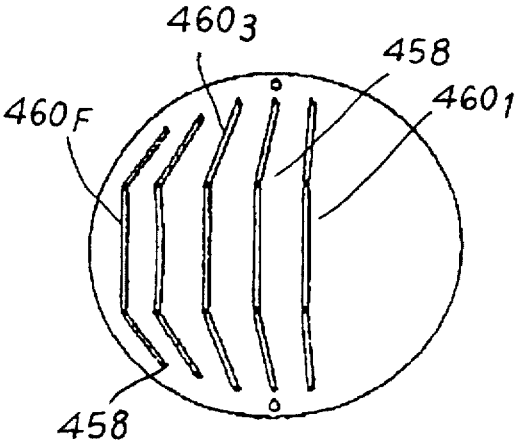
FIG. 32 is a plan view of a portion of the temperature compensation means.
Figure 31:
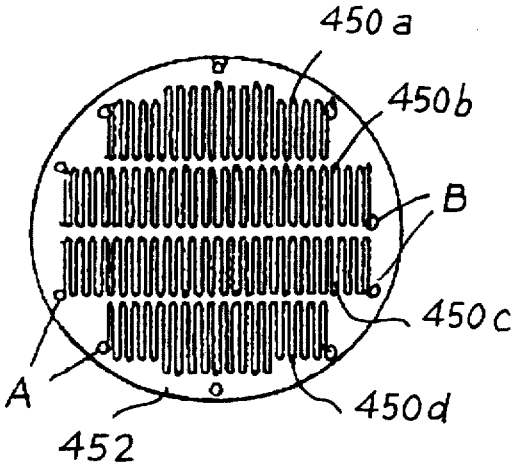
FIG. 31 is a plan view of the multichannel head loss device.

FIGS. 33 show a preferred embodiment of the control for the shutters 462. Each shutter 462 is constituted by a cavity 470 having a first face 472 and a second face 474. Two orifices 476 and 478 open out into the first face 472, which orifices are respectively connected to one of the passages 460 and to the outlet pipe 464. Against the face 474, there is mounted a deformable diaphragm 480 which is secured via its periphery to the face 474. The control member is constituted by a liquid having a high coefficient of thermal expansion, such as alcohol. This liquid is contained in an enclosure 482. The enclosure 482 is in communication with the rear face of the membrane 480 via an orifice 484. During a rise in temperature, the liquid contained in the enclosure 482 expands and its expansion causes the central portion of the diaphragm 480 to deform. The diaphragm presses against the face 472 of the cavity 470, thereby closing the orifices 476 and 478. The volume of each enclosure 482 is determined in such a manner that beneath its reference temperature $T_1$, the diaphragm 480 does not close the orifices 476 and 478, and from said temperature $T_1$, the diaphragm closes the orifices by taking up the position shown in FIG. 33*b*.

Naturally other methods of controlling the shutters as a function of adjustment temperature could be implemented. For example, the membrane could be replaced by bellows.

It is also clear that the means for adjusting flow rate and for compensating flow rate as a function of temperature could be employed with liquid dispensing devices other than those described above. Nevertheless, it will be understood that these dispositions are justified only where it is necessary to dispense a liquid within flow rate constraints that are very severe.

We claim:

1. A device for dispensing a fluid at very low flow rates, comprising:

a container suitable for receiving said fluid;

an outlet for said fluid flow; and capillary head loss means for controlling said fluid flow rate, said head loss means comprising first and second mechanical parts in mutual contact that are fixed relative to each other, said mechanical parts defining at their interface a channel of small section and of great length, said channel section being less than 1 $mm^2$;

said first part of the head loss means having a plane surface, and said second part of said head loss means having a plane surface in which at least one groove is formed, said device further comprising means for pressing said plane surfaces against each other in a sealed manner, with said channel being formed by said groove.

2. A device according to claim 1, wherein the section of said channel is less than 0.2 $mm^2$.

3. A device according to claim 1, wherein said head loss means are disposed at the outlet from said container, and said channel is connected firstly to said outlet and secondly to said container whereby said fluid can flow along said channels.

4. A device according to claim 1 wherein said channel is connected firstly to the outside of said container and secondly to the inside of said container, whereby the fluid outside said container can flow along said channel towards said container, thereby causing the fluid contained in said container to flow out therefrom.

5. A device according to claim 4, wherein said container withstands pressure, and has an orifice that is separate from said outlet in that said container includes, internally, a first sealed deformable bag containing said fluid and connected to said outlet, an external source containing a pressurized control fluid, a first end of the channel of the head loss means being connected to said orifice, and the second end of the channel being connected to said source of fluid, and means for applying pressure to said enclosure, whereby a controlled flow rate of control fluid penetrates into said container and causes controlled outflow of the fluid contained in said first bag.

6. A device according to claim 5, said source of control fluid comprises a deformable enclosure containing said fluid and means for applying pressure to said enclosure.

7. A device according to claim 5 wherein said container includes, internally, a second deformable sealed bag connected to said orifice of the container.

8. A device according to claim 6, wherein the container withstands pressure, said outlet is secured to the container, said container is provided with an end wall opposite said outlet, said end wall being provided with an orifice, said channel of the head loss means having a first end connected to said orifice and a second end opening out to the atmosphere, said device further comprising support means for said container to hold the container, while in use, in a position such that said outlet is disposed at the bottom end of said container, said outlet providing head loss that is much less than that provided by the head loss means.

9. A device according to claim 8, wherein said outlet is extended by a tube mounted inside said container.

10. A device according to claim 8, wherein further comprising a deformable sealed bag placed inside the container, said bag being connected to said orifice.

11. A device according to claim 4, wherein said container withstands pressure, said fluid outlet is secured to one end of said container, said head loss means are mounted inside said container, close to the end wall of the container opposite from said outlet, a first end of the channel of the head loss means is connected to an air intake formed through the wall of said container, said device further comprising support means for said container for holding it, in use, in a position such that said outlet is disposed at the bottom end of the container, the second end of said channel being connected to a first vertical pipe whose open end penetrates into overflow-forming means when said device is in its in-use position, an edge of the overflow being connected to a second vertical pipe whose free end opens out to the inside of said container.

12. A device according to claim 8, it further comprising a receptacle outside said container, secured to said support means, the opening of said receptacle facing the outlet of said container, the end of said outlet penetrating into said container.

13. A device according to claim 4, wherein said container containing said fluid withstands pressure and includes a first end provided with said outlet and a second end provided with an orifice, said device it further comprising a second element including said head loss means, said second element including an air intake connected to a first end of the channel of the head loss means and an outlet opening connected to the second end of the channel, and a flexible hose connected to said orifice of the container and to the outlet opening of said second element.

14. A device according to claim 4 wherein said fluid to be dispensed is a liquid.

15. A device for dispensing a fluid at very low flow rates, comprising:

a container suitable for receiving said fluid;

an outlet for said fluid flow; and capillary head loss means for controlling said fluid flow rate, said head loss means comprising first and second mechanical parts in mutual contact that are fixed relative to each other, said mechanical parts defining at their interface a channel of small section and of great length, said channel section being less than 1 $mm^2$;

said channel being connected firstly to the outside of said container and secondly to the inside of said container, whereby the fluid outside said container can flow along said channel towards said container, thereby causing the fluid contained in said container to flow out therefrom;

said first part of the head loss means having a plane surface, and said second part of said head loss means having a plane surface in which at least one groove is formed, said device further comprising means for pressing said plane surfaces against each other in a sealed manner, with said channel being formed by said groove.

16. A device according to claim 15, wherein the plane surface of the first part includes n separate grooves, thereby providing n separate channels each presenting a first end and a second end, and in that said device further comprises control means for selectively connecting a first end of at least one of said channels to a first stationary duct and stationary means for connecting the second ends of all of the channels to a second stationary duct.

17. A device according to claim 16, wherein each channel corresponds to a different head loss.

18. A device according to claim 15, it further comprising p orifices opening out into said channel at p different points, said fluid is admitted to a first end of the channel, each orifice and said second end of the channel is connected to an outlet duct via a respective controllable shutter member, said device further comprising control means for controlling the shutter members as a function of p+1 distinct temperature values, a shutter member being closed for a temperature whose rank corresponds to the rank from the first end of the channel of the position of the orifice associated with the shutter member.

19. A device according to claim 16 further comprising nx(p+1) orifices, p of said orifices opening out in p different points in each of the n channels between the fluid admission first end thereof and the second end thereof, p+1 link ducts for interconnecting the n same-rank orifices in the channels counting from said first ends, and the n second ends of the channels, p+1 shutter members, each shutter member being associated with one of said link ducts, an outlet hose connected to each link duct via the associated shutter member, and means for controlling the shutter members as a function of p+1 distinct temperature values, a shutter member being closed for temperatures of rank corresponding to the rank from the first end of the channels corresponding to the position of the duct associated with the shutter member.

20. A device according to claim 19, wherein each shutter member comprises a cavity having a first wall into which there opens out a first passage connected to a link duct and a second passage connected to said outlet pipe, a deformable element suitable for occupying a rest first position in which it is spaced apart from said wall whereby the fluid can flow between the two passages, and a closure second position in which a portion of said element is pressed against said wall of the cavity whereby said passages are closed, and said control means comprise p+1 control elements, each control element being associated with one of p+1 temperatures, and with the corresponding shutter member, the control elements being suitable for bringing said deformable element of the shutter member into its second position when the corresponding temperature is reached and in maintaining it in said position for higher temperatures.

21. A device according to claim 20, wherein the deformable element is secured to said cavity via its periphery, and each control element comprises an enclosure having a rigid wall and containing a fluid that expands with temperature, said enclosure being connected to said cavity so that expansion of the fluid is applied to said deformable element and brings said element into its second position at the corresponding temperature.

22. A device according to claim 15, it further comprising a sheet of deformable material disposed between the plane surfaces of the two parts.

23. A device according to claim 22, wherein the plane surface on the part that does not include the groove(s) is provided with portions in relief that cooperate with said sheet.

24. A device according to of claim 15, said second part has two plane surfaces each of which has a groove formed therein presenting a first end and a second end, and said first part is constituted by two half-parts each presenting a plane face pressed against a respective one of the plane faces of the second part.

25. A device according to claim 24, wherein the first ends of the grooves are connected to a common fluid inlet, and in that the second end of each groove is connected to a respective fluid outlet.

26. A device according to claim 24, wherein the first end of a first groove is connected to a fluid inlet, the second end of the first groove is connected to the second end of the second groove, and the first end of the second groove is connected to a fluid outlet.

27. A device for dispensing a fluid at very low flow rates, comprising:

a container suitable for receiving said fluid;

an outlet for said fluid flow; and capillary head loss means for controlling said fluid flow rate, said head loss means comprising first and second mechanical parts in mutual contact that are fixed relative to each other, said mechanical parts defining at their interface a channel of small section and of great length, said channel section being less than 1 $mm^2$;

said channel being connected firstly to the outside of said container and secondly to the inside of said container, whereby the fluid outside said container can flow along said channel towards said container, thereby causing the fluid contained in said container to flow out therefrom;

said first part of the head loss means being a cylinder of diameter D, and the second part of the head loss means being a helical wire having touching turns wound around said cylinder, the diameter d of said wire being much smaller than the diameter D of said cylinder, said channel being formed by the gaps between the side surface or said cylinder and the turns of wire.

28. A device for dispensing a fluid at very low flow rate comprising:

a container for receiving a fluid, said container having a top and bottom part;

an outlet for said fluid, said outlet being disposed at said bottom part of said container; and capillary head loss means defining a capillary flow passage distinct from said outlet, said passage having a first end communicating with the outside of said container, said container being disposed in an area filled full with a second fluid, and a second end communicating with the inside of said container, whereby a controlled flow rate of said second fluid penetrates into said container, and a controlled flow rate of the dispensed fluid passes through the outlet of said container.

29. A device for dispensing a liquid at a very low flow rate comprising:

a container for receiving said liquid, said container having a top part and a bottom part; said container being disposed in an area filled full with a gas;

an outlet for said liquid, said outlet being disposed at the bottom part of said container; and capillary head loss means defining a capillary flow passage distinct from said outlet, said passage having a first end communicating with the outside of said container, and a second end communicating with the inside of said container, whereby a controlled flow rate of said gas penetrates into said container, and a controlled flow rate of the liquid passes through the outlet of said container.

30. A device for dispensing a fluid at very low flow rates, comprising:

a container suitable for receiving said fluid;

an outlet for said fluid flow; and capillary head loss means for controlling said fluid flow rate, said head loss means comprising first and second mechanical parts in mutual contact that are fixed relative to each other, said mechanical parts defining at their interface a channel of small section and of great length, said channel section being less than 1 $mm^2$;

said first part of the head loss means being a cylinder of diameter D, and the second part of the head loss means being a helical wire having touching turns wound around said cylinder, the diameter d of said wire being much smaller than the diameter D of said cylinder, said channel being formed by the gaps between the side surface or said cylinder and the turns of wire.

* * * * *